US006089942A

United States Patent [19]

Chan

[11] Patent Number: 6,089,942

[45] Date of Patent: Jul. 18, 2000

[54] INTERACTIVE TOYS

[75] Inventor: Albert W. T. Chan, Hong Kong, The Hong Kong Special Administrative Region of the People's Republic of China

[73] Assignee: Thinking Technology, Inc., Nassau, Bahamas

[21] Appl. No.: 09/057,384

[22] Filed: Apr. 9, 1998

[51] Int. Cl.[7] ..... A63H 29/10; A63H 3/28

[52] U.S. Cl. ..... 446/175; 446/299; 446/302

[58] Field of Search ..... 446/175, 297, 446/299, 300, 301, 302, 303

[56] References Cited

U.S. PATENT DOCUMENTS

| | | | |
|---|---|---|---|
| 3,912,694 | 10/1975 | Chiappe et al. . | |
| 4,078,316 | 3/1978 | Freeman . | |
| 4,231,184 | 11/1980 | Corris . | |
| 4,245,430 | 1/1981 | Hoyt . | |
| 4,267,551 | 5/1981 | Dankman et al. . | |
| 4,318,425 | 3/1982 | Stowell et al. . | |
| 4,447,058 | 5/1984 | Tojza | 273/121 A |
| 4,479,329 | 10/1984 | Fraden | 446/475 |
| 4,696,653 | 9/1987 | McKeefery . | |
| 4,717,364 | 1/1988 | Furukawa . | |
| 4,855,725 | 8/1989 | Fernandez | 434/308 X |
| 4,857,030 | 8/1989 | Rose . | |
| 4,923,428 | 5/1990 | Curran . | |
| 4,930,236 | 6/1990 | Hart | 446/175 X |
| 4,938,483 | 7/1990 | Yavetz . | |
| 5,029,214 | 7/1991 | Hollander | 446/297 X |
| 5,169,156 | 12/1992 | Smollar . | |
| 5,213,510 | 5/1993 | Freeman . | |
| 5,314,336 | 5/1994 | Diamond . | |
| 5,340,317 | 8/1994 | Freeman . | |
| 5,375,847 | 12/1994 | Fromm et al. . | |
| 5,607,336 | 3/1997 | Lebensfeld . | |
| 5,795,213 | 8/1998 | Goodwin | 446/302 X |

*Primary Examiner*—D. Neal Muir

*Attorney, Agent, or Firm*—Alex Porat; Blake, Cassels & Graydon LLP

[57] ABSTRACT

The interactive toy includes a speech synthesizer for converting digital data representative of speech into audible synthesized speech; an infra-red transceiver for wirelessly communicating infra-red messages over a field-of-view to a second toy; a microphone; and a selector for selecting between a transmission mode and a stand-alone mode. The toy is programmed so that, in the transmission mode, it receives a first infra-red signal from a second toy identifying a synthesized speech phrase generated by the second toy, supplies selected digital speech data representative of a reply synthesized speech phrase to the speech synthesizer in response to the first signal, and transmits a second infra-red signal to the second toy indicative of the selected reply phrase. In the stand-alone mode, the toy monitors the microphone for sound input, and supplies selected digital speech data to the speech synthesizer after the sound input has ceased. The toy also includes a motor, connected to a movable body part, which is actuated in timed relation to the synthesized speech, in order to mimic human mannerisms when speaking.

20 Claims, 10 Drawing Sheets

DIALOGUE A

| | RV data | Phrase | TX data |
|---|---|---|---|
| Toy 1: | | "Look at all these people!" | #0100 |
| Toy 2: | #0100 | "Stand back, buddy. I'll protect you. I'll just fire up my laser gun." | #1100 |
| Toy 1: | #1100 | "Hold on there. Can't you see these are our friends!" | #0100 |
| Toy 2: | #0101 | "They may be aliens in disguise. You can never be too careful." | #1100 |
| Toy 1: | #1101 | "These folks we can trust. They're our kids!" | |

DIALOGUE B

| | RV data | Phrase | TX data |
|---|---|---|---|
| Toy 1: | | "Buddy - your just a toy!" | #1000 |
| Toy 2: | #1000 | "No way amigo. I'm more valuable than a toy. I'm a collectable." | #0001 |
| Toy 1: | #0001 | "Ha; on what planet?" | |

Fig. 3

INTERACTIVE TOYS

FIELD OF INVENTION

The invention generally relates to the art of toy-making, and more particularly to interactive toys, such as dolls, which simulate intelligent conversation therebetween.

BACKGROUND OF INVENTION

Talking dolls, i.e., dolls which emit human-like speech or sound typically in response to some physical stimuli, have been successfully manufactured and marketed for many years. However, a doll which simulates intelligent conversation between itself and a counterpart doll has not, to the applicant's knowledge, been successfully commercialized.

For example, U.S. Pat. No. 4,857,030 issued Aug. 15, 1989 to Rose and assigned to Coleco Industries, Inc. discloses conversing dolls which comprise speech synthesizing systems and appear to intelligently converse with one another. These dolls employ radio frequency transceivers in order to signal, over a radio link, an indication of what particular synthesized phrase has been spoken by a first doll and to request a response which appears to be intelligent with respect to the synthesized speech of the first doll.

The above-mentioned conversing dolls suffer from a variety of deficiencies affecting their cost and performance. For example, the consumer must purchase two dolls, each of which is relatively expensive due to the incorporation of the radio transceiver devices. In addition, although the dolls may simulate human speech, the dolls themselves are static and do not realistically simulate human mannerisms when speaking, thereby depreciating the realism of play.

Accordingly, the invention seeks to provide a low cost, multi-functional, interactive doll capable of amusing children in a variety of ways. The invention also seeks to provide an interactive doll which mimics human mannerisms while simulating speech to thereby enhance the realism of play. In addition, the invention seeks to provide imaginative ways of engaging the interactive capability of conversing dolls, especially in interfacing with the typical daily routine of child's life.

SUMMARY OF INVENTION

According to one aspect of the invention, an interactive toy is provided which includes a speech synthesizer, connected to a memory, for converting digital data representative of speech into audible synthesized speech. The toy also includes an infra-red transceiver for wirelessly communicating infra-red messages over a field-of-view to a second toy. A data processing means is connected to the speech synthesizer and, in a transmission mode, is operative to receive a first infra-red signal from the second toy identifying a synthesized speech phrase generated by the second toy, supply selected digital speech data representative of a reply synthesized speech phrase to the speech synthesizer in response to the first signal, and transmit a second infra-red signal to the second toy indicative of the selected reply phrase.

In the preferred embodiment, the interactive toy includes a built-in microphone, and a selector for selecting between a stand-alone mode and the infra-red transmission mode. In the event the stand-alone mode is selected, the processing means is operative to monitor the microphone for sound input, and supply selected digital speech data to the speech synthesizer after the sound input has ceased.

In the preferred embodiment, the toy also includes a motor connected to a movable body part. The motor is connected to the processing means which is operative to actuate the motor in timed relation to the synthesized speech produced by the speech synthesizer. In the preferred embodiment, the toy is a doll having movable eyelids and jaws. In this manner, the toy, especially in the form of the preferred doll, mimics human mannerisms when simulatingly conversing with another doll.

In the preferred embodiment, the interactive toy further includes a switch, and the processing means is operative to initiate a simulated conversation with the second toy upon actuation of the switch. In alternative embodiments, the conversation may be initiated by stimulating a magnetic proximity sensor or a motion detector.

BRIEF DESCRIPTION OF DRAWINGS

The foregoing and other aspect of the invention are discussed in greater detail below with reference to the following drawings, provided for the purpose of description and not of limitation, wherein:

FIG. 3 is a data diagram illustrating a sample simulated intelligent conversation between two interactive toys according to the preferred embodiment;

DETAILED DESCRIPTION OF PREFERRED EMBODIMENTS

Figure 1:
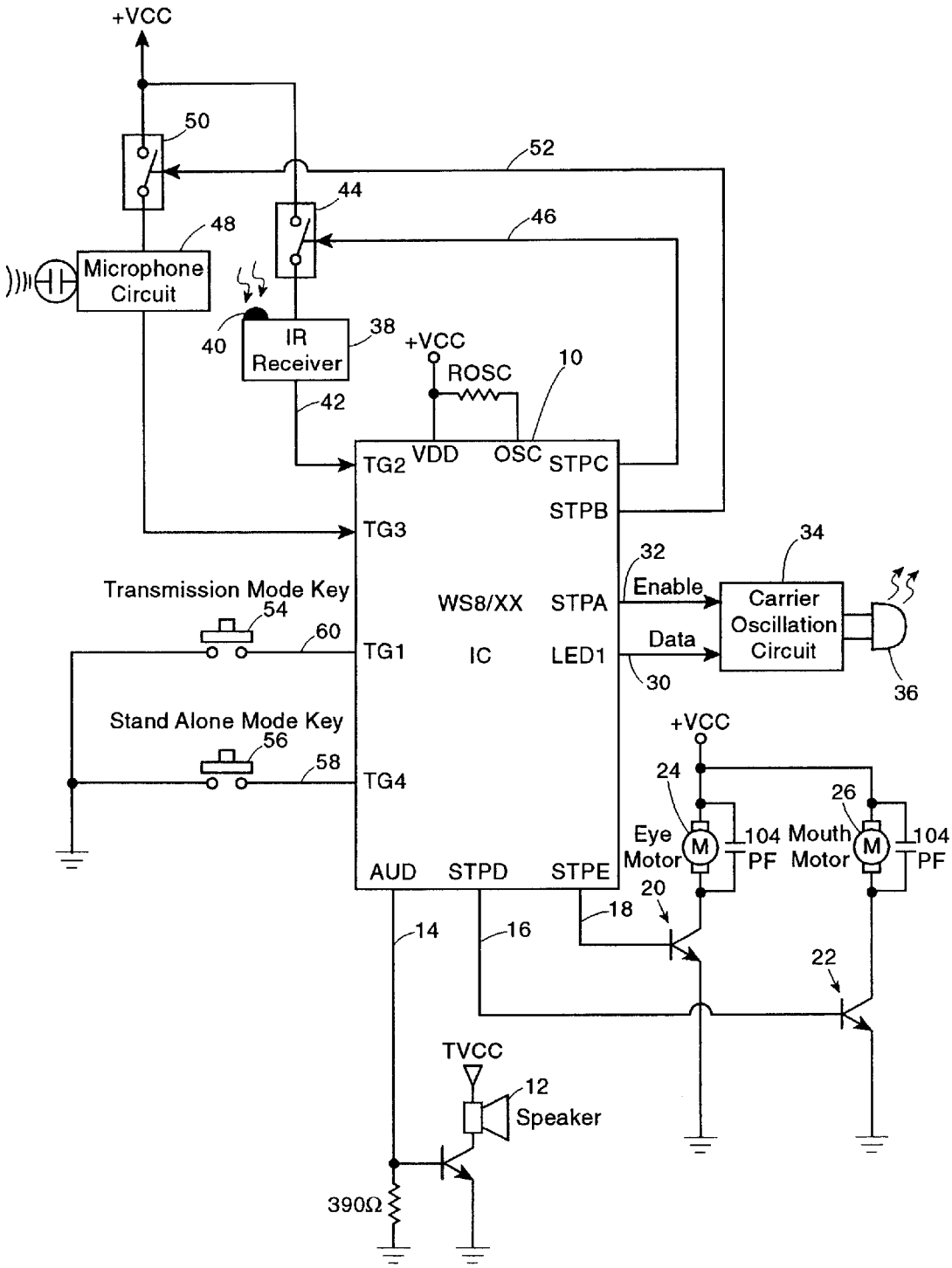
FIG. 1 is a system block diagram of electrical circuitry employed in a preferred embodiment of the invention.

FIG. 1 is block diagram of electrical circuitry employed in a preferred embodiment of the invention. This electrical circuitry is preferably mounted in a cavity of the interactive toy so as to be hidden from view.

As shown in FIG. 1, the preferred embodiment employs a low cost, programmable, single integrated circuit, speech synthesizer 10 having an on-chip memory for storing digital data representative of phrases of speech. The speech synthesizer 10 is preferably any of the W851XX family of speech synthesizers available from Winbond Electronics Corp. of Hsinchu, Taiwan, Republic of China. The speech synthesizer 10 provides a limited number of microprocessor-type instructions for program development and includes an interface to more powerful data processing capability such as provided by a full scale central processing unit or microprocessor. Alternative types of speech synthesizers which may be used include the TSP50C0x/1x family of speech synthesizers from Texas Instruments Incorporated, Dallas, Tex., U.S.A., which include a built-in full scale microprocessor. The latter device, however, is more expensive to procure than the preferred Winbond speech synthesizer.

As shown in FIG. 1, the speech synthesizer 10 is connected to a speaker 12 through an audio output line 14. The speech synthesizer 10 is also connected through output lines 16 and 18 to the base inputs of transistors 20 and 22 which are respectively connected to motors 24 and 26. The transistors 20 and 22 are installed in series with the motors 24 and 26 so as to control the supply of current thereto. The motors 24 and 26 are connected to movable body parts of the toy.

Figure 2A:
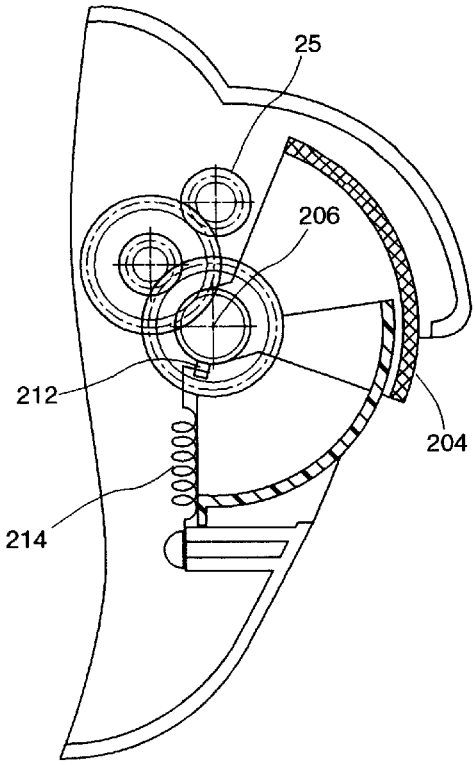
FIG. 2A is a cross-sectional view of a movable toy body part, specifically a movable eyelid mechanism in a retracted position, in accordance with the preferred embodiment.
Figure 2B:
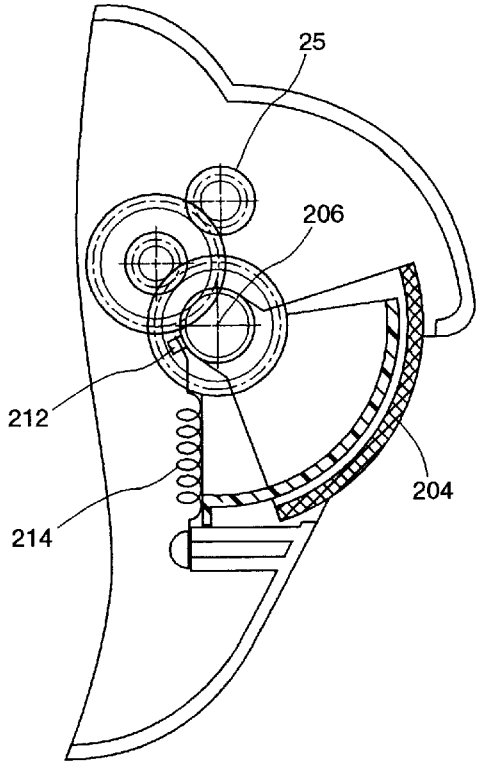
FIG. 2B is a cross-sectional view of the movable eyelid mechanism in an extended position.
Figure 2C:
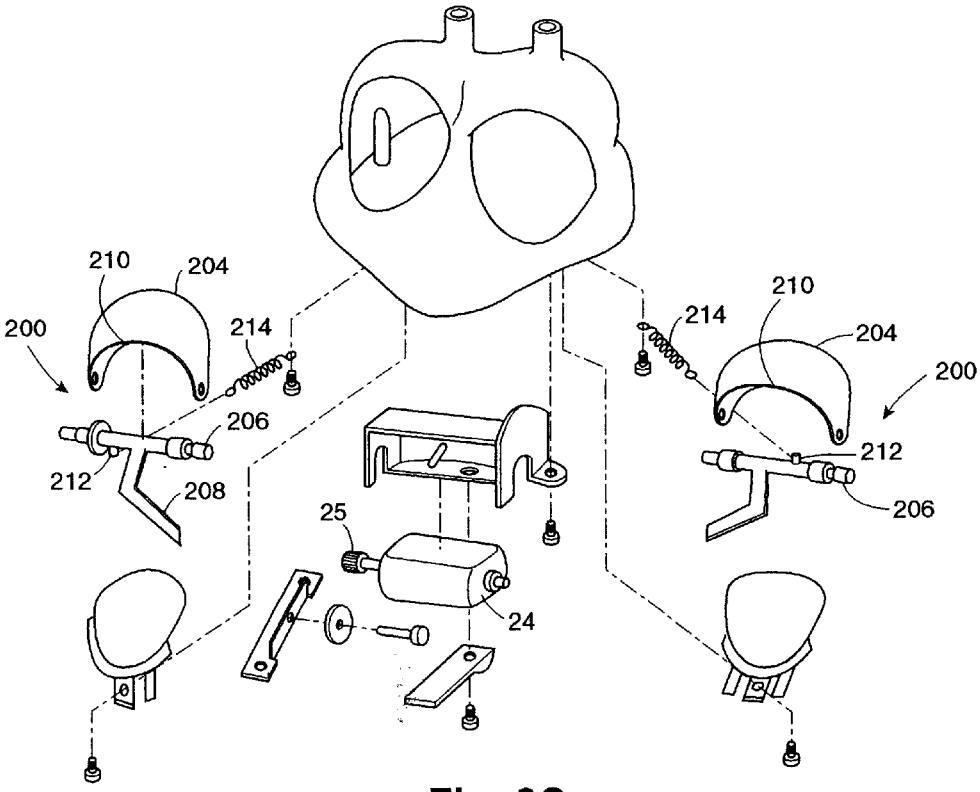
FIG. 2C is an exploded view of the movable eyelid mechanism.

For example, as shown in FIGS. 2A–2C, motor 24 is connected to a movable eyelid mechanism 200 through a gear train 202. The mechanism 200 comprises a movable eyelid part 204 which is pivotally disposed about a shaft 206. The shaft 206 includes an integral extended arm 208 which rides against an outer edge 210 of the eyelid part 204. The shaft also features a protuberance 212 which is connected to a spring 214 anchored to the body of the toy. Actuation of the motor 24 for a brief period causes the shaft 206 to rotate over an angle corresponding to the distance of travel provided the spring 214, and thereby cause the arm 208 to push the eyelid part 204 to an extended position as shown in FIG. 2B. When the motor 24 is turned off, the spring 214 retracts causing the arm 208 to pull the eyelid part 204 back to a retracted position, as shown in FIG. 2A.

Figure 2F:
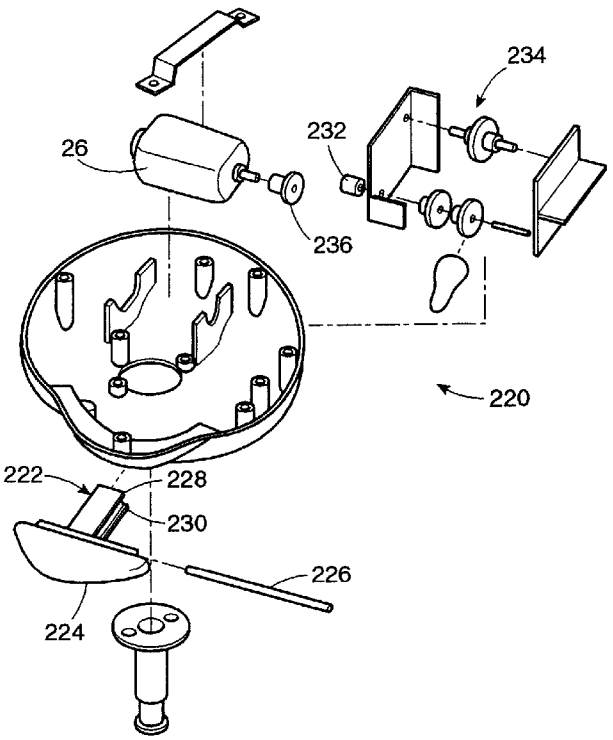
FIG. 2F is an exploded view of the movable jaw mechanism.
Figure 2D:
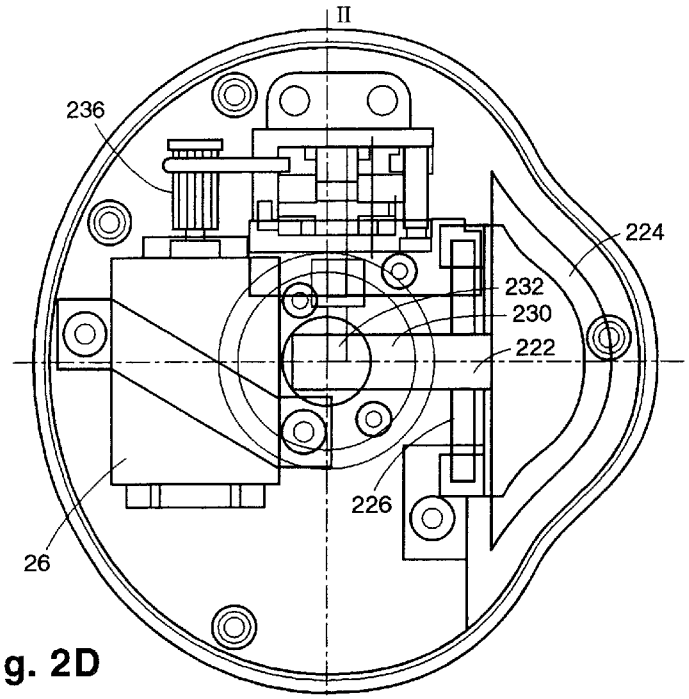
FIG. 2D is a cross-sectional view of a movable toy body part, specifically a movable jaw mechanism, in accordance with the preferred embodiment.
Figure 2E:
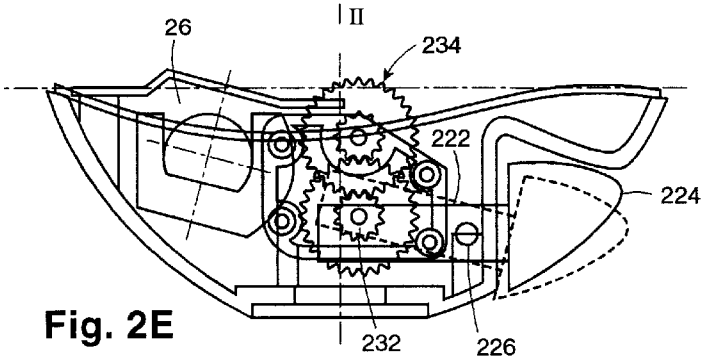
FIG. 2E is a cross-sectional view of the movable jaw mechanism taken along line II—II in FIG. 2D.

Motor 26, as shown in FIGS. 2D–2F, is connected to a movable jaw mechanism 220. The mechanism 220 comprises a pivot arm 222 which features an external jaw part 224 at a distal end thereof. The pivot arm 222 pivots about an axle 226 mounted to the body of the toy. The proximal end of the pivot arm 222 features a rectangularly shaped beam 228 having a recess or slot 230 therein. An eccentric stub shaft 232 is connected to the proximal end of the pivot arm 222 and rides against the slot 230. The eccentric stub shaft 232 is mounted to a gearbox 234 which is connected to an output gear 236 of motor 26. Actuating the motor 26 causes the eccentric stub shaft 232 to rotate and rock the pivot arm 222, thereby causing the jaw part 224 to open and close.

Motors 24 and 26 may be connected to alternative movable body parts, depending on the design or character of the interactive toy. For instance, if the interactive toy embodies the character of Dumbo the Flying Elephant (TM—Walt Disney Company) the movable body parts may be elephants' ears.

Referring back to FIG. 1, the speech synthesizer 10 is also connected through a data output line 30 and a data enable line 32 to a carrier oscillation circuit 34 which, in turn, is connected to an infrared emitting diode 36. The carrier oscillation circuit 34, as known in the art per se, produces a carrier binary pulse stream which is modulated in accordance with the data present on output line 30. The data enable output 32 controls whether or not the carrier oscillating circuit 34 produces a modulated carrier signal at its output. When enabled, the infrared emitting diode 36 radiates the modulated carrier signal of circuit 34 into space at infra-red (IR) frequencies over a predetermined field-of-view. That is, the radiation pattern produced by diode 36 is not omni-directional but, having a progressively decreasing radiation output at increasing angular displacements, resembles a substantially defined beam. In the preferred embodiment, infrared emitting diode 36 is an EL-1L7 GaAlAs diode manufactured by the Kodenshi Corp. of Kyoto, Japan, which radiates an output beam over an approximately forty (40) degree field-of-view.

The speech synthesizer is also connected to an infra-red receiver 38 which includes a built-in infra-red detector 40. The IR receiver 38, as known in the art per se, demodulates a modulated binary pulse stream such as produced by the carrier oscillation circuit 34, and produces the baseband signal at input line 42. The preferred IR receiver 38 is a model PIC-26043SM optic remote control receiver module (typically used as a remote control receiver in consumer electronic devices) which is also manufactured by the Kodenshi Corp. of Kyoto, Japan. Power to the IR receiver 38 is enabled and disabled by a switch 44 which is controlled by the speech synthesizer 10 via output line 46. Collectively, the carrier oscillation circuit 36 and the IR receiver 38 provide an infra-red transmission means for wirelessly communicating messages to a second interactive toy over a predetermined field-of-view.

In the preferred embodiment, infrared emitting diode 36 and infra-red photodetector 40 are mounted in the interactive toy such that it must face in a natural direction to a second interactive toy in order to close a wireless communication loop therebetween. For instance, if both interactive toys resemble human figures, diodes 36 and 40 are preferably mounted facing outwards toward the front of the toy, e.g., in the abdomen or eye sockets. This ensures that, ignoring reflections, the interactive toys will only be able to wirelessly communicate and hence simulate conversation with one another when they are substantially facing one another, thereby mimicking the normal pose of two individuals talking to one another and enhancing the realism of play.

A microphone 48 is also connected to the speech synthesizer 10. Power to the microphone 48 is enabled and disabled via a switch 50 which is controlled by speech synthesizer 10 through an output line 52.

Two momentary contact keys or push-buttons 54 and 56 are connected to the speech synthesizer 10 via trigger input lines 58 and 60. The preferred embodiment features two possible modes for the interactive toy which are triggered by actuation of one the momentary contact push-buttons 54 and 56. Push-button 54, when actuated, causes the interactive toy to enter into a "transmission" mode wherein two such interactive toys simulate intelligent conversation therebetween. Push-button 56, when actuated, causes the interactive toy to enter into a "stand-alone" mode wherein the user can directly interact with the toy, i.e., without requiring a second toy.

In the transmission mode, an initiating event, such as a second actuation of push-button 54, causes one of at least two interactive toys or dolls to randomly select a "dialogue" and play a "phrase" thereof. In this specification, the term, "phrase" refers to a collection of synthesized speech data that is audibly produced by one toy typically prior to response by the counterpart toy. The term "dialogue" refers to a particular group of predetermined possible phrases audibly generated by at least two interactive toys in order to simulate an intelligent conversation. For example, referring to FIG. 3, toy 1 begins a simulated conversation corresponding to dialogue A by playing the phrase "Look at all these people!". As soon as the synthesized phrase is generated by toy 1, it sends an infra-red message to toy 2 identifying the particular phrase, #0100, that was audibly produced by toy 1. Based on this message, toy 2 selects and plays a predetermined reply phrase or one of a plurality of predetermined possible reply phrase. In the illustrated dialogue, this phrase is "Stand back, buddy. I'll protect you! I'll just fire up my laser gun!" As soon as the synthesized reply phrase is articulated by toy 2, it sends an infra-red message to toy 1 identifying the particular phrase, #1100, that was audibly produced by toy 2. Based on this message, toy 1 selects and plays a predetermined reply phrase or one of a plurality of predetermined possible reply phrases, and signals toy 2 accordingly. The process continues until the end of the dialogue is reached.

In the preferred embodiment each synthesized phrase is also associated with "action" data specifying how motors 24 and 26 are actuated in timed relation to the playing of a phrase by speech synthesizer 10. For example, using the notation "Λ" and "v" to respectively represent the turn-on and turn-off of eyelid motor 24, toy 1 could be programmed to move its eyelid for phrase, #0010, as follows: "ΛLookv at Λall thesev people!"

Figure 4:
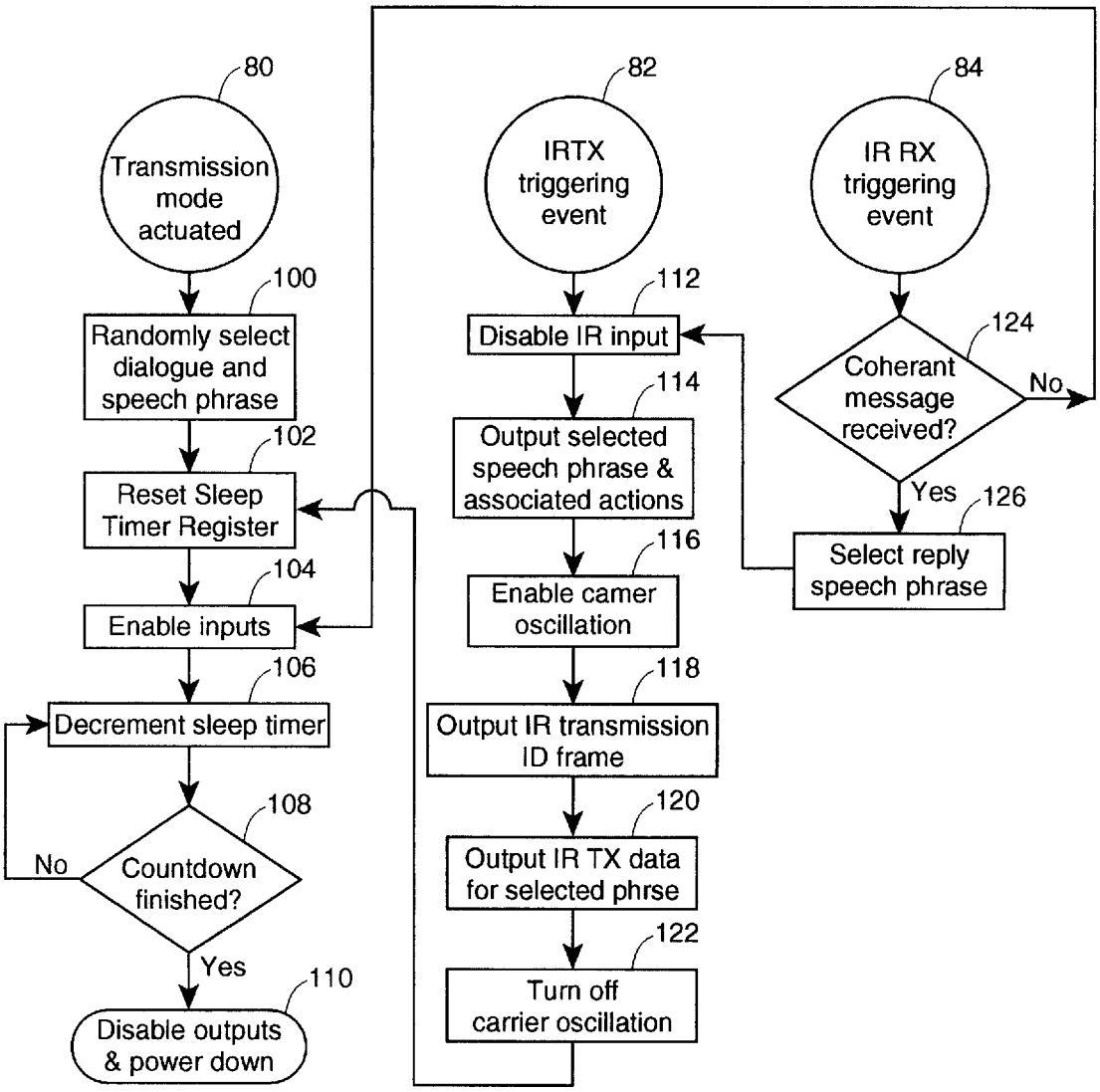
FIG. 4 is a flow chart illustrating the programming of a transmission mode according to the preferred embodiment wherein two interactive toys may simulate intelligent conversation therebetween.
Figure 5A:
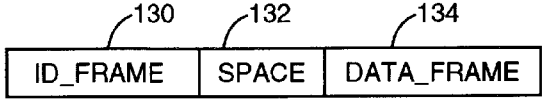
FIG. 5 is a protocol diagram illustrating the preferred format of messages wirelessly communicated between interactive toys.
Figure 5B:
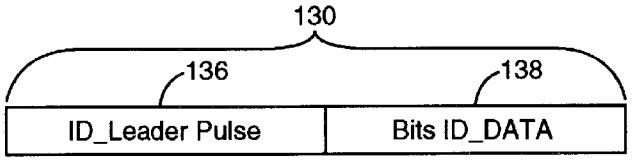
Figure 5C:
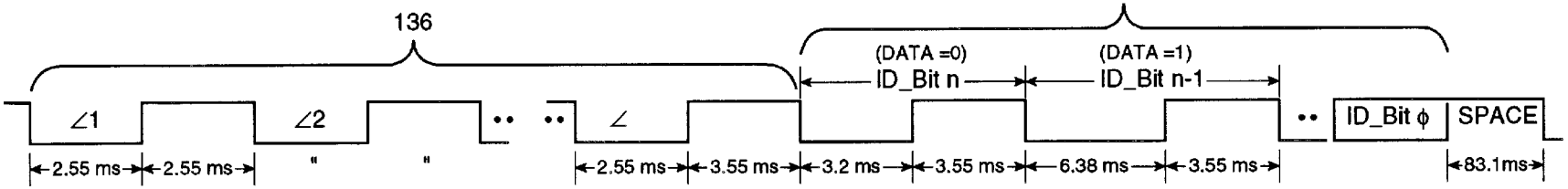
Figure 5D:
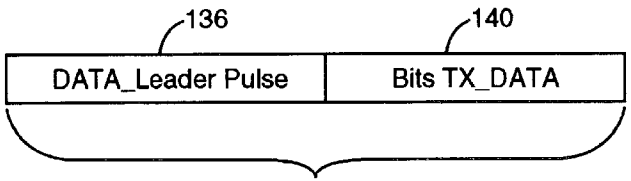

FIG. 4 is a flowchart illustrating the preferred programming of speech synthesizer 10 for the transmission mode. There are at least three events which correspond to major entry points in the flowchart. Event 80 corresponds to the actuation of push-button 54 in order to place the toy in the transmission mode. Event 82 corresponds to an event or stimuli, such as a second activation of push-button 54, which causes the toy to initiate a dialogue between it and a second toy. Event 84 corresponds to reception of an infra-red signal by the IR receiver 38.

When the transmission mode is actuated at event 80, the speech synthesizer 10 randomly selects a dialogue in the event the present toy initiates simulated conversation with a second toy. At step 102, a dedicated speech synthesizer register used to implement a sleep countdown timer (hereinafter "sleep timer register") is reset to an initial value. At step 104, all inputs to the speech synthesizer are enabled. Steps 106 and 108 form a loop used to decrement the sleep timer register until the sleep timer countdown is finished. The sleep timer countdown is preferably set to approximately 60 seconds. If during this time event 82 or event 84 did not occur, or if the toy has not been placed in the stand-alone mode, then at step 110 all outputs of the speech synthesizer 10 are disabled and it is placed in a low-power-drain sleep mode.

When event 82 corresponding to initiation of a simulated conversation occurs, switch 44 (FIG. 1) is opened at step 112 in order to disable the IR receiver 38 and hence all IR input to the speech synthesizer. This ensures that the following steps will not be prematurely interrupted by IR signal input.

At step 114, a selected phrase is output to the speech synthesizer 10 and motors 24 and 26 are actuated in timed relation to the synthesized speech in accordance with the associated actions. In the preferred embodiment, each phrase is stored as a plurality of linked speech components, and speech synthesizer 10 sets output lines 16 and 18 (FIG. 1) which control motors 24 and 26 at discrete points during the playback of the phrase, between the playback of the individual phrases. For example, the speech and action sequence "ΛLookv at Λall thesev people!" comprises speech synthesizer instructions to: (a) set output line 18 to high; (b) play speech component "Look"; (c) set output line 18 to low; (d) play speech component "at"; (e) set output line 18 to high; (f) play speech component "all these"; (g) set output line 18 to low; and (h) play speech component "people". This procedure is necessitated by the single execution thread design of the preferred Winbond speech synthesizer, however, other types of speech synthesizers may enable a greater degree of parallelism in executing general purpose microprocessor and speech synthesis specific instructions.

At step 116, the data enable line 32 (FIG. 1) is actuated in order to enable the carrier oscillation circuit 34. At steps 118 and 120 the identifier for the selected speech sequence is transmitted, as described in greater detail below, to a second or counterpart interactive toy. At step 122, the carrier oscillation circuit 34 is disabled and control passes to steps 102–110 discussed above to begin another sleep countdown period.

When event 84 corresponding to reception of an IR signal occurs, step 124 checks whether in fact a valid message has been received, as described in greater detail below. If not, then control is passed back to step 104 to continue the sleep timer countdown. If a valid message is received, then, as described in greater detail below, step 126 selects a reply phrase in response to a phrase identifier transmitted by the counterpart interactive toy. Control is then passed to step 112 in order to un-interruptibly play the selected phrase and its associated actions, transmit the identifier of the reply phrase to the counterpart interactive toy, and restart the sleep timer countdown.

The preferred transmission protocol for communication messages between interactive toys is illustrated in FIG. 5. As shown in FIG. 5(*a*), each message comprises an identifier frame 130, a space 132, and a data frame 134. The identifier frame 130 comprises preamble 136 and ID data 138 as illustrated in FIG. 5(*b*). The preamble 136 is preferably a leading pulse train of specified length having a 50% duty cycle, as shown in FIG. 5(*c*), which serves to alert the speech synthesizer that ID data 138 is about to be transmitted. The ID data 138 which follows identifies which specific interactive toy the message is addressed to, thereby providing a means for discriminating amongst a number of interactive toys. Alternatively, the ID data 138 may be used to identify the particular toy sending the message. Alternatively still, the ID data 138 may e used as a protocol identifer indicating how the following TX data should be used. FIG. 5(*d*) shows the data frame 134 which preferably comprises the preamble 136 and TX data 140. The TX data 140 preferably identifies a recently generated speech phrase produced by the interactive toy which sent the message.

Figure 6:
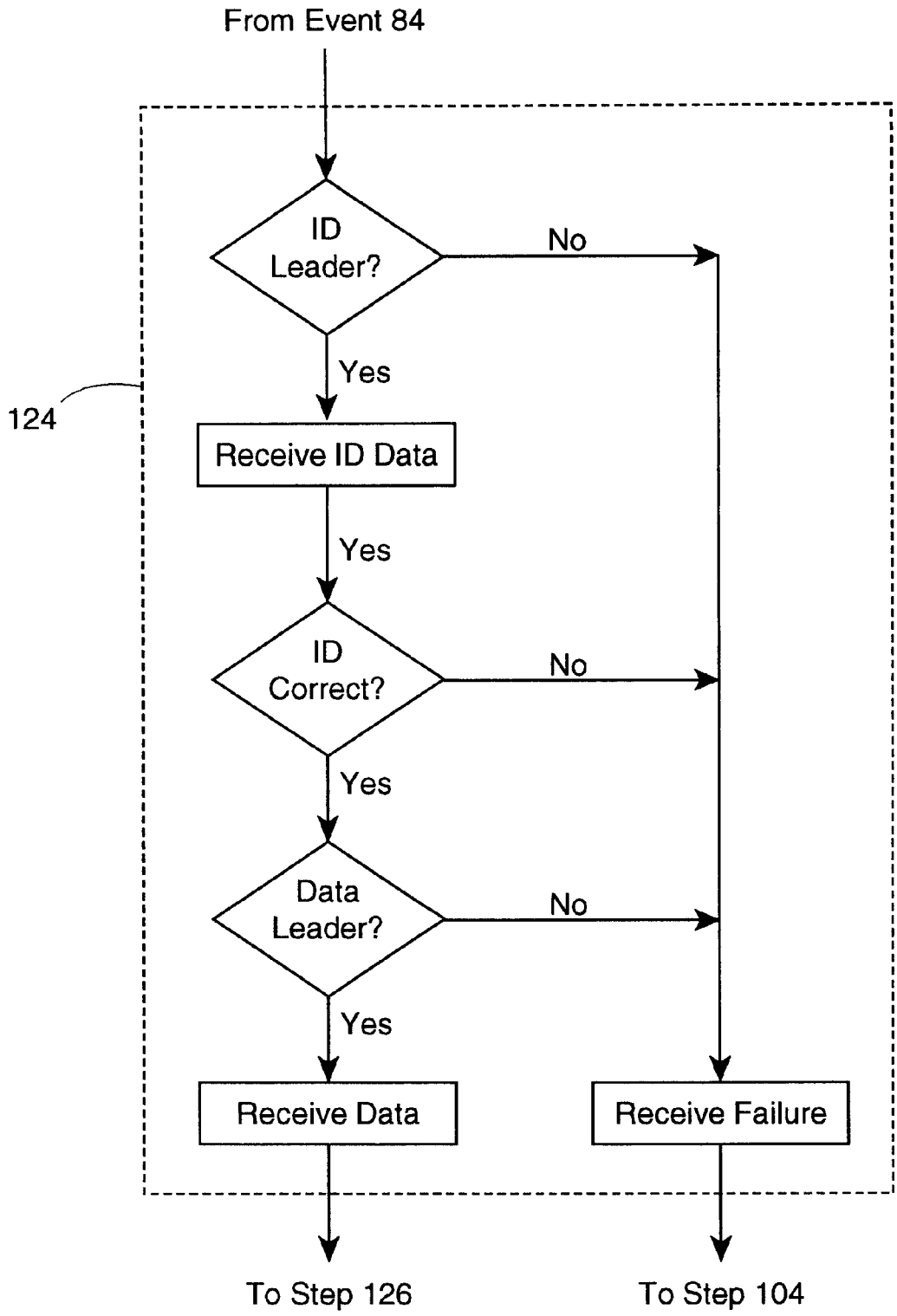
FIG. 6 is a flow chart illustrating a preferred method for determining whether a received infra-red signal is a valid message or not.

Referring additionally to FIG. 6, step 124 of the FIG. 3 flowchart which checks whether or not a valid message was received by IR receiver 38 is shown in greater detail. The process steps of FIG. 6 will be self-explanatory in view of the discussion above in relation to the transmission protocol illustrated in FIG. 5.

Figure 7:
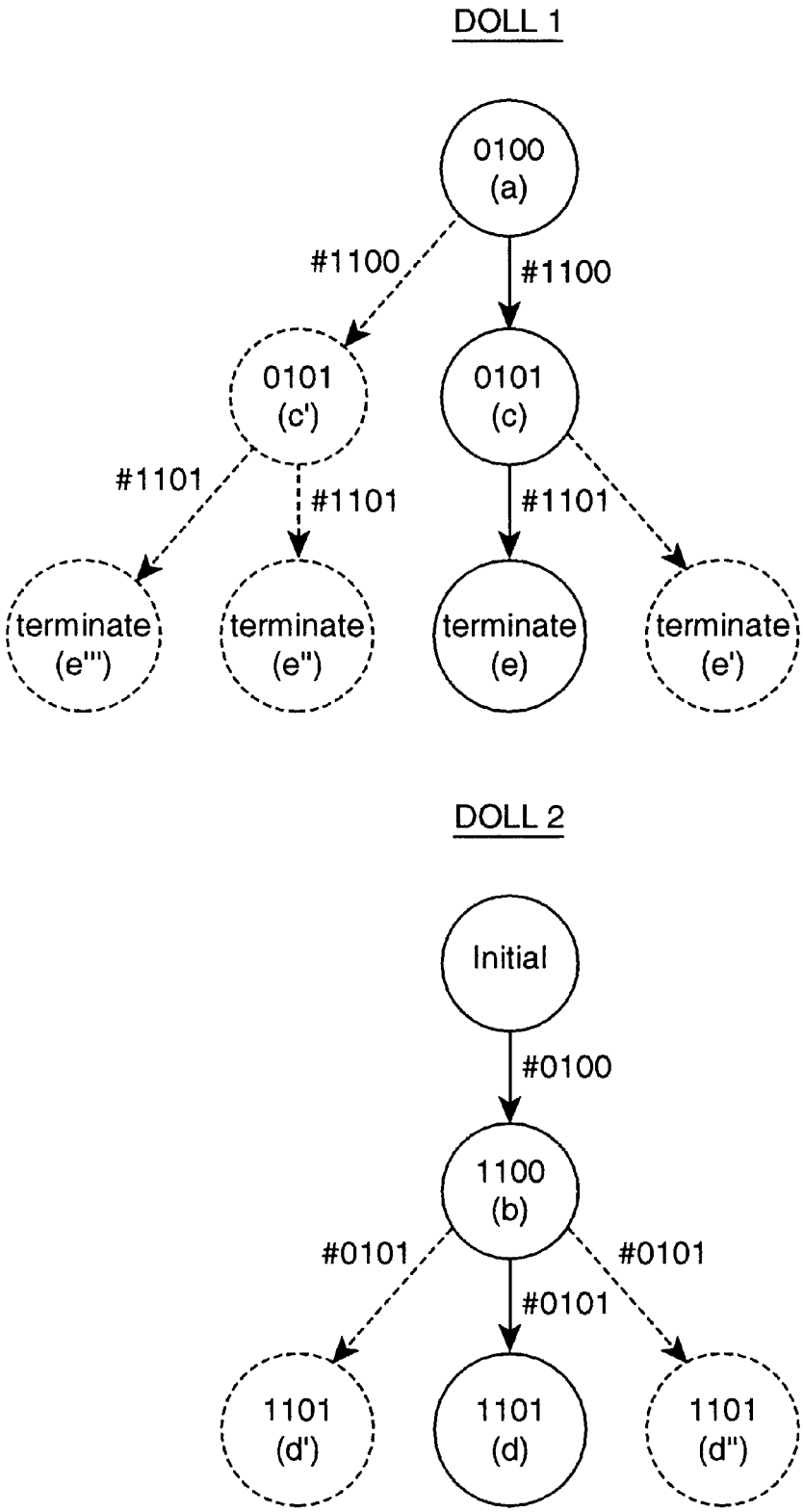
FIG. 7 is a diagram of two state tables illustrating a preferred mechanism for generating substantially non-repetitive simulated conversation between two interactive toys.

FIG. 7 illustrates a state table which is used by the preferred embodiment to select a reply speech phrase at step 126 of the FIG. 4 flowchart. The preferred state table resembles a data tree, wherein each node represents a speech phrase state. Two trees, one for each of a pair of conversing toys, are required to represent a dialogue. Each node of the data tree preferably has multiple leaves depending therefrom, with each leaf representing a possible branch from the current speech phrase state. Thus, continuing with the example dialogue A shown in FIG. 3, the initial state of toy 1 is labelled 0100. Toy 2 receives #0100 as input, causing it to go to state 1100. Toy 1 subsequently receives #1100 as input. At this point, toy 1 can randomly select between leaf (c) representing reply speech phrase "Stand back, buddy. I'll protect you! I'll just fire up my laser gun!" or leaf (c') (shown in stippled lines) representing an alternative speech phrase, such as "Yes. These are BIG people!". In this manner, the set of possible speech phrases for any given dialogue can be relatively easily structured to simulate substantially non-repetitive intelligent conversation between two interactive toys.

Figure 8:
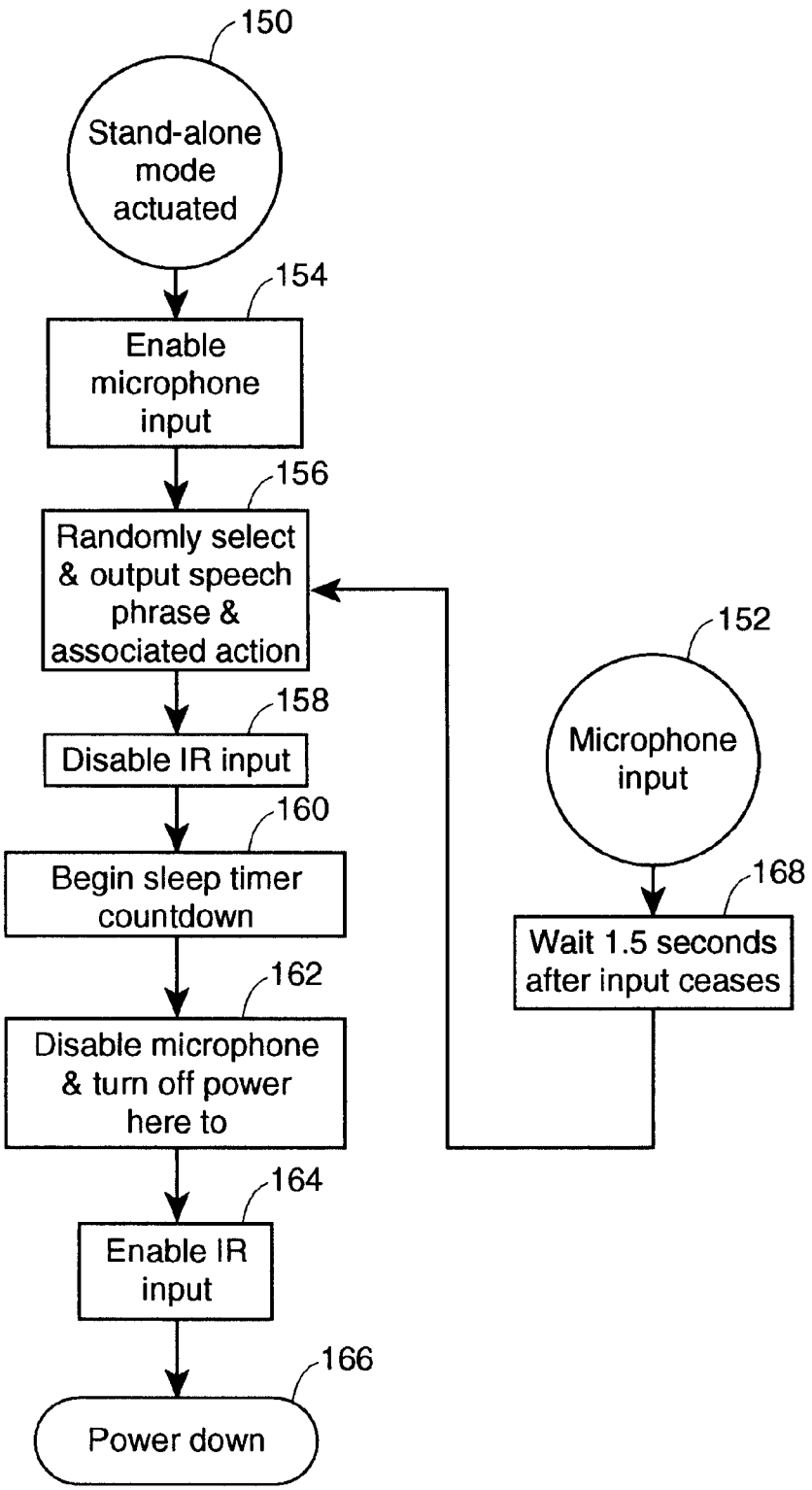
FIG. 8 is a flow chart illustrating the programming of a stand-alone mode according to the preferred embodiment wherein an interactive toy responds to voice stimuli presented by a user.

FIG. 8 is a flowchart illustrating the preferred programming of speech synthesizer 10 for the stand-alone mode. There are at least two events which correspond to major entry points in the flowchart: event 150 corresponds to the user selection of the stand-alone mode; and event 152 corresponds to the presence of sound input at the microphone 48.

When event 150 occurs, then switch 50 (FIG. 1) is closed at step 154 to enable microphone input. At step 156, a speech and action sequence is randomly selected and played by the speech synthesizer 10, as described above. At step 158, switch 44 (FIG. 1) is opened to disable the IR receiver 38 and all IR input to the speech synthesizer. This ensures that the following steps will not be interrupted by IR input, although actuating the transmission mode will immediately pass control to event 80 of FIG. 4. At step 160, the sleep timer countdown of preferably sixty seconds is started. If no intervening event occurs prior to the termination of the sleep timer countdown, then at steps 162, 164 and 166, switch 50 is opened to disable the microphone 48, switch 44 is closed to power the IR receiver 38 and enable IR input to the speech synthesizer, and the speech synthesizer is placed in the low-power-drain sleep mode.

However, if at event 152 sound input is sensed at the microphone, then the speech synthesizer 10 waits at step 168 for 1.5 seconds until the sound input ceases before control is passed to step 156 where another speech and action sequence is randomly selected and played by the speech synthesizer 10, and another sleep countdown period is started. If desired, a unitary state table/tree such as shown in FIG. 7 may be employed to link sequential speech phrases played by the speech synthesizer in this mode in order to simulate cohesive speech by the interactive toy.

Figure 9:
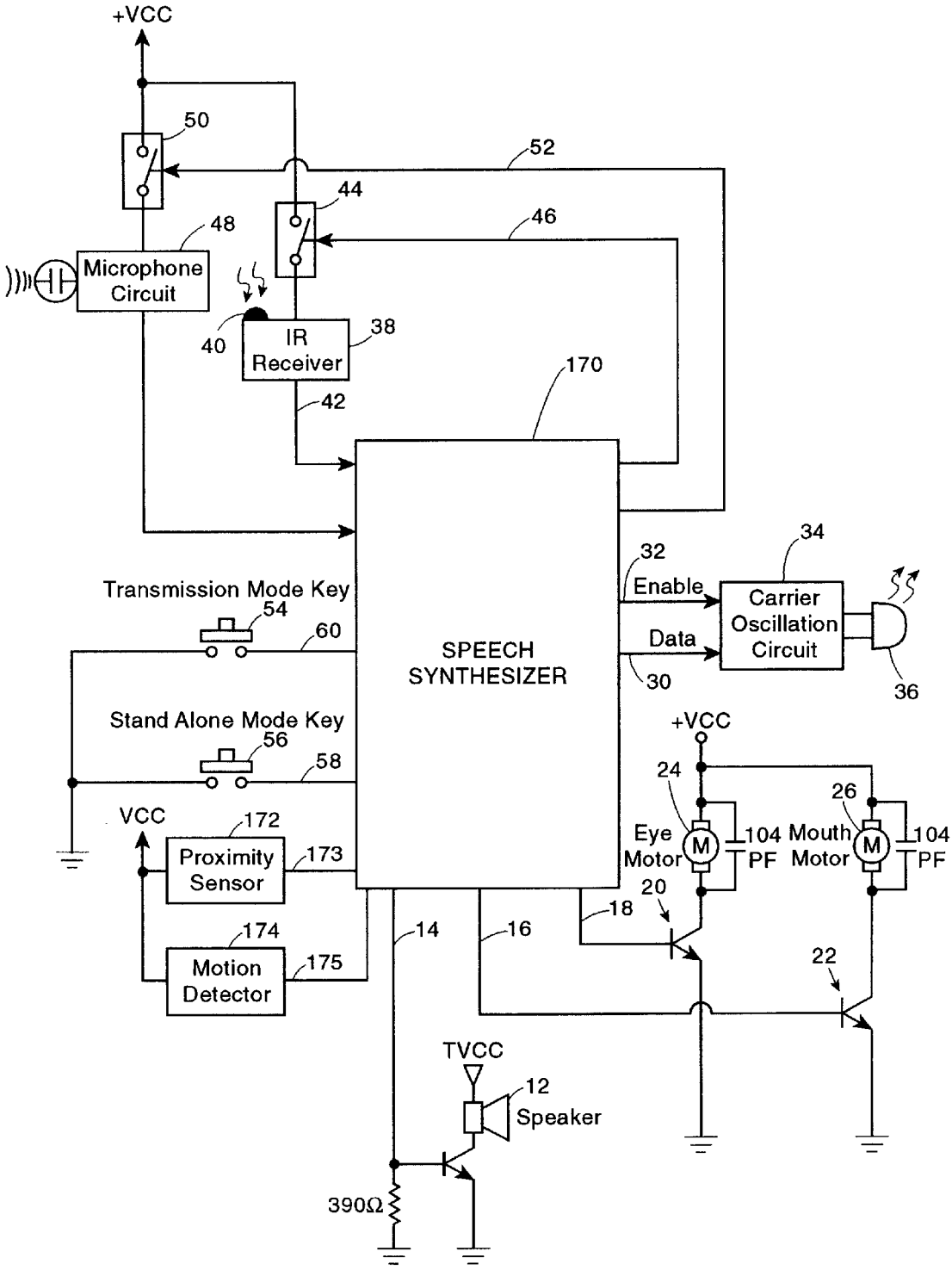
FIG. 9 is a system block diagram of electrical circuitry employed in an alternative embodiment of the invention.

As discussed above, pressing the transmission mode push-button 54 twice in succession causes the interactive toy of the preferred embodiment to initiate a simulated conversation with a second interactive toy. FIG. 9 shows an alternative embodiment of the electrical circuitry (of FIG. 1) comprising additional means for initiating the simulated conversation. The alternative electrical circuitry includes a speech synthesizer 170 which is connected to a magnetic proximity sensor 172 and a motion detector 174. In the alternative embodiment, stimulating either of these devices constitutes an occurrence of event 82 (FIG. 4), thereby causing the toy to initiate a dialogue between it and a second toy.

Magnetic proximity sensor 172 is preferably a TS560dry-reed switch manufactured by Standex Electronics, Cincinnati, Ohio, U.S.A. This device is actuated when a permanent magnet is brought near it, and thus is capable of providing a changing edge input on input line 173. Preferably, the reed switch is mounted in one interactive toy and the permanent magnet is mounted in the counterpart interactive toy so that when the two toys are brought into proximity with one another the simulated speech is initiated. For example, when the interactive toys are dolls resembling human figures, the reed switch and counterpart permanent magnet may be mounted in the hands of the dolls so that the simulated conversation is initiated when the two dolls "shake hands". Alternative proximity sensors are available, for instance, from the SUNX company of Japan.

Motion detector 174 is well-known is the art and available from a variety of sources. The motion detector preferably includes an enabling switch (not shown) used to arm the motion detector. The motion detector may also be used in the stand-alone mode to spontaneously trigger a pre-selected or randomly selected synthesized speech phrase from the doll. Thus, for example, when the motion detector is armed and stimulated, the interactive toy may be programmed to inform his child owner: "Intruder alert. Intruder alert. Someone has entered your room!".

Those skilled in the art will appreciate that numerous modifications and variations may be made to the preferred embodiments without departing from the spirit and scope of the invention.

What is claimed is:

1. An interactive toy, comprising:

a memory for storing digital data representative of speech phrases;

a speech synthesizer, connected to the memory, for converting the digital data into audible synthesized speech phrases;

an infra-red transceiver for communicating infra-red signals over a field-of-view to a second toy;

a switch for enabling a user of the toy to select between a stand-alone mode and an infra-red transmission mode;

a microphone; and a processor, connected to the switch, the microphone, the infra-red transceiver, the speech synthesizer, and the memory, for determining the selected mode and, (i) in the event the stand-alone mode is selected, (a) monitoring the microphone for sound input, and (b) in the event that sound input is present, selecting digital speech data representative of a speech phrase and supplying such data to the speech synthesizer; and (ii) in the event the infra-red transmission mode is selected, (a) receiving a first infra-red signal from the second toy indicative of a speech phrase audibly generated by the second toy, (b) selecting digital speech data representative of a reply speech phrase in response to the first signal and supplying such data to the speech synthesizer, and (c) transmitting a second signal to the second toy indicative of the selected phrase.

2. The toy according to claim 1, further including a motor connected to a movable body part, wherein said processing means is operative to actuate the motor in timed relation to the synthesized speech produced by the speech synthesizer.

3. The toy according to claim 2, wherein the movable body part is an eyelid.

4. The toy according to claim 2, wherein the movable body part is a jaw.

5. The toy according to claim 1, wherein processor is operative to initiate a simulated conversation with the second toy upon actuation of the switch to the infra-red transmission mode.

6. The toy according to claim 1, further comprising a proximity sensor, and wherein the processor is operative to initiate a simulated conversation with the second toy upon stimulation of the proximity sensor.

7. The toy according to claim 6, wherein the proximity sensor is a magnetic proximity sensor.

8. The toy according to claim 1, further comprising a motion detector, and wherein the processor is operative to initiate a simulated conversation with the second toy upon stimulation of the motion detector.

9. The toy according to claim 1, wherein, in response to the first infra-red signal from the second toy, the processor is operative to substantially randomly select at least one reply speech phrase from a plurality of predetermined possible reply speech phrases.

10. The toy according to claim 1, further including means for placing the speech synthesizer in a low-power-drain sleep mode in the event no conversation initiating event or infra-red signal input has occurred within a predetermined time period.

11. The toy according to claim 1, further including means for placing the speech synthesizer in a low-power-drain sleep mode in the event no sound input has occurred within a pre-determined time period.

12. An interactive toy, comprising:

a microphone;

a movable body part having a motor connected thereto;

a memory for storing digital data representative of speech phrases;

a speech synthesizer, connected to the memory, for converting the digital data into audible synthesized speech phrases;

an infra-red transceiver for communicating infra-red signals over a field-of-view to a second toy;

a switch for enabling a user of the toy to select between a stand-alone mode and a dual mode; and a processor connected to the motor, the microphone, the infra-red transceiver, the speech synthesizer, and the memory, for receiving a first infra-red signal from the second toy indicative of a speech phrase audibly generated by the second toy, selecting digital speech data representative of a reply speech phrase in response to the first signal and supplying such data to the speech synthesizer, actuating the motor in timed relation to the synthesized speech produced by the speech synthesizer, and transmitting a second signal to the second toy indicative of the selected phrase, all in response to the switch being set in the dual-mode, and for monitoring the microphone for sound input, selecting digital speech data representative of a speech phrase, and supplying such data to the speech synthesizer after the sound input has ceased, all in response to the switch being set in the stand-alone mode.

13. The toy according to claim 12, wherein the movable body part is an eyelid.

14. The toy according to claim 12, wherein the movable body part is a jaw.

15. The toy according to claim 12, further comprising a proximity sensor, wherein the processor is operative to initiate a simulated conversation with the second toy upon stimulation of the proximity sensor.

16. The toy according to claim 15, wherein the proximity sensor is a magnetic proximity sensor.

17. The toy according to claim 12, further comprising a motion detector, wherein the processor is operative to initiate a simulated conversation with the second toy upon stimulation of the motion detector.

18. The toy according to claim 12 wherein, in response to the first infra-red signal from the second toy, the processor is operative to substantially randomly select at least one (1) reply speech phrase from a plurality of predetermined possible reply speech phrases.

19. The toy according to claim 12, further including means for placing the speech synthesizer in a low-power-drain sleep mode in the event no conversation initiating event or infra-red signal input has occurred within a predetermined time period.

20. The toy according to claim 12, further including means for placing the speech synthesizer in a low-power-drain sleep mode in the event no sound input has occurred within a pre-determined time period.

* * * * *